US010655353B2

(12) United States Patent
Carless

(10) Patent No.: US 10,655,353 B2
(45) Date of Patent: May 19, 2020

(54) DEVICE FOR SECURING A POST

(71) Applicant: Glenn Carless, New South Wales (AU)

(72) Inventor: Glenn Carless, New South Wales (AU)

(73) Assignee: SYSTEMS PYT LTD, New South Wales (AU)

( * ) Notice: Subject to any disclaimer, the term of this patent is extended or adjusted under 35 U.S.C. 154(b) by 0 days.

(21) Appl. No.: 16/311,617

(22) PCT Filed: Jun. 20, 2017

(86) PCT No.: PCT/AU2017/000135
§ 371 (c)(1),
(2) Date: Dec. 19, 2018

(87) PCT Pub. No.: WO2017/219061
PCT Pub. Date: Dec. 28, 2017

(65) Prior Publication Data

US 2019/0234097 A1 Aug. 1, 2019

(30) Foreign Application Priority Data

Jun. 20, 2016 (AU) ..... 2016902402

(51) Int. Cl.
*E04H 12/22* (2006.01)
*E02D 5/54* (2006.01)
(Continued)

(52) U.S. Cl.
CPC ..... *E04H 12/2215* (2013.01); *E02D 5/54* (2013.01); *E02D 5/80* (2013.01); *E02D 27/42* (2013.01); *E04H 12/22* (2013.01); *E04H 12/223* (2013.01)

(58) Field of Classification Search
CPC ... E04H 12/22; E04H 12/2215; E04H 12/223; E04H 12/2292; E02D 5/54; E02D 5/80; E02D 27/42
(Continued)

(56) References Cited

U.S. PATENT DOCUMENTS 420,122 A * 1/1890 Stillman ..... E02D 5/80 52/158
737,642 A * 9/1903 Lombard ..... E04H 12/2215 52/154
(Continued)

FOREIGN PATENT DOCUMENTS

CA 2838757 C * 9/2019 ..... E02D 5/80

OTHER PUBLICATIONS

ISR/WO from PCT application PCT/AU2017/000135, dated Sep. 7, 2017.

*Primary Examiner* — Ryan D Kwiecinski
(74) *Attorney, Agent, or Firm* — FisherBroyles, LLP; Ian R. Walsworth

(57) ABSTRACT

A device (100) for securing a post (105) comprises a central portion (110) defining an aperture (115) therethrough configured to engage the post (105) and two or more support members (120) extending outwardly from the central portion (110). Each support member (120) comprises a first portion (125) and a second portion (130), the first and second portions (125, 130) each comprising at least one support element (135, 140) configured to extend towards and further engage the post (105). The second portion (130) is configured to penetrate a post-mounting surface (132) in a substantially longitudinal direction relative to the post (105), thereby securing the post (105) with respect to shear forces acting on the post (105) in a direction substantially perpendicular to the longitudinal direction.

10 Claims, 11 Drawing Sheets

(51) Int. Cl.
*E02D 5/80* (2006.01)
*E02D 27/42* (2006.01)

(58) Field of Classification Search
USPC ..... 52/153, 154, 155, 170, 298, 699, 704
See application file for complete search history.

(56) References Cited

U.S. PATENT DOCUMENTS 798,945 A * 9/1905 Berntson ..... E04H 12/2215 52/154
1,402,561 A * 1/1922 Banks ..... E04H 12/2215 52/154
2,295,431 A * 9/1942 Shepard ..... E04H 12/223 248/530
2,964,145 A * 12/1960 Clatfelter ..... E04H 12/223 52/158
3,342,444 A * 9/1967 Nelson ..... E04H 12/2215 52/165
4,004,383 A * 1/1977 Watanabe ..... E04H 12/2215 52/154
4,592,422 A * 6/1986 Hipp ..... E21B 33/04 166/382
4,641,478 A * 2/1987 Nelson, Jr. ..... E04H 12/22 52/700
5,984,587 A * 11/1999 Odle ..... E01F 9/685 248/530
6,035,576 A * 3/2000 Bozeman ..... A47G 7/042 47/47
2003/0089833 A1* 5/2003 Hsu ..... E04H 12/2215 248/532
2009/0090836 A1* 4/2009 Harris ..... E04H 12/2215 248/530
2015/0096260 A1 4/2015 Intagliata et al.

* cited by examiner

DEVICE FOR SECURING A POST

CROSS REFERENCE TO RELATED APPLICATIONS

This application is a national stage application under 35 U.S.C. 371 and claims the benefit of PCT Application No. PCT/AU2017/000135 having an international filing date of Jun. 20, 2017, which designated the United States and further claims the benefit of Australian Patent Application No. 2016902402 filed Jun. 20, 2016. The disclosures of each of the aforementioned applications are incorporated herein by reference.

TECHNICAL FIELD

The present invention relates to a device for securing a post.

BACKGROUND OF THE INVENTION

Screw piles are a form of footing or anchoring system used in the building or construction industry. They are typically in the form of a hollow shaft having a helical attachment welded to one end of the shaft. This end of the shaft is driven into the ground by rotational force, whereby the helical attachment cuts through the ground in a similar manner to a screw. Once the shaft reaches a desired depth in the ground, the helical attachment acts to secure the shaft with respect to the ground and also with respect to forces acting on the shaft. The attachment to the shaft may alternatively take the form of a combination of a single horizontal plate bolted to the shaft and a number of sharp, vertical plates extending from the horizontal plate. The sharp, vertical plates penetrate and engage the ground to secure the shaft.

Another known system for securing a pile or post in the ground is through the use of a concrete footing for the ground-engaging end of the pile or post. To create the concrete footing, a portion of the ground surrounding the pile is excavated and filled with concrete. Once the concrete sets, the pile or post is permanently secured in place.

One disadvantage of such known systems is that they may not be sufficient to counter high lateral forces acting on the pile, post or shaft, for example in severe weather situations where sustained strong winds can cause the pile, post or shaft to collapse. Further, such known systems are typically designed to have the pile or post permanently fixed to an attachment or concrete footing within the ground, thus making it difficult to remove the pile or post from the ground without the use of complex machinery. Therefore, such known systems do not have the capacity for the pile or post to easily be removed from one site, transported to another site and re-used.

SUMMARY OF THE INVENTION

It is an object of the present invention to substantially overcome, or at least ameliorate, one or more disadvantages of existing arrangements, or to at least provide the public with a useful choice.

According to a first aspect of the present invention, there is provided a device for securing a post, the device comprising: a central portion defining an aperture therethrough configured to engage the post; and two or more support members extending outwardly from the central portion, each support member comprising a first portion and a second portion, the first and second portions each comprising at least one support element configured to extend towards and further engage the post, wherein the second portion is configured to penetrate a post-mounting surface in a substantially longitudinal direction relative to the post, thereby securing the post with respect to shear forces acting on the post in a direction substantially perpendicular to the longitudinal direction.

The central portion may comprise a first surface and a second surface, the first surface defining a plane along which the first portion extends, wherein the second portion of the support member extends in a direction substantially perpendicular to the plane.

The first surface may be configured to abut the post-mounting surface and is arranged to be substantially parallel to the post-mounting surface.

A first support element of the first portion may engage with the post at a first location, wherein the first location is positioned on a first side of the central portion, and a second support element of the second portion may engage with the post at a second location, wherein the second location is positioned on a second side of the central portion, and wherein the first and second sides of the central portion are opposing.

The first support element may initially extend from the first portion in a direction substantially perpendicular to the plane along which the first portion extends before extending towards the post, and the second support element may extend towards the post in a direction parallel to a plane along which the second portion extends.

An inner edge of the central portion may engage with the post circumferentially around the post.

The second portion may comprise a cutting edge to penetrate the post-mounting surface.

The device may be configured to rotate relative to the post.

The central portion and the three or more support members may be integrally formed.

The first and second portions of each support member may be integrally formed.

Each of the first support elements may be integrally formed with the connected first portion, and each of the second support elements may be integrally formed with the connected second portion.

According to a second aspect of the present invention, there is provided a device for securing a post, the device comprising: a central portion defining an aperture therethrough configured to engage the post; and a support member extending outwardly from the central portion, the support member comprising two or more support portions, wherein the two or more support portions are each configured to penetrate a post-mounting surface in a substantially longitudinal direction relative to the post, thereby securing the post with respect to shear forces acting on the post in a direction substantially perpendicular to the longitudinal direction.

The support member may include two or more apertures, the device further comprising a support assembly adapted to be mounted in the two or more apertures and removably engage with the central portion.

The support assembly may comprise two or more support elements, each support element being configured to extend towards and further engage the post.

The support assembly may further comprise two or more clamp members, each clamp member being configured to engage with two adjacent support elements.

The device may further comprise two or more arcuate legs, each arcuate leg being configured to be inserted into one of the apertures of the support member and engage the support element to assist in engaging the post.

The at least one arcuate leg may comprise a cutting edge to penetrate the post-mounting surface.

Each support portion may also comprise a cutting edge to penetrate the post-mounting surface.

BRIEF DESCRIPTION OF THE DRAWINGS

Embodiments of the invention will now be described, by way of example only, with reference to the accompanying drawings, in which.

DETAILED DESCRIPTION

Figure 1:
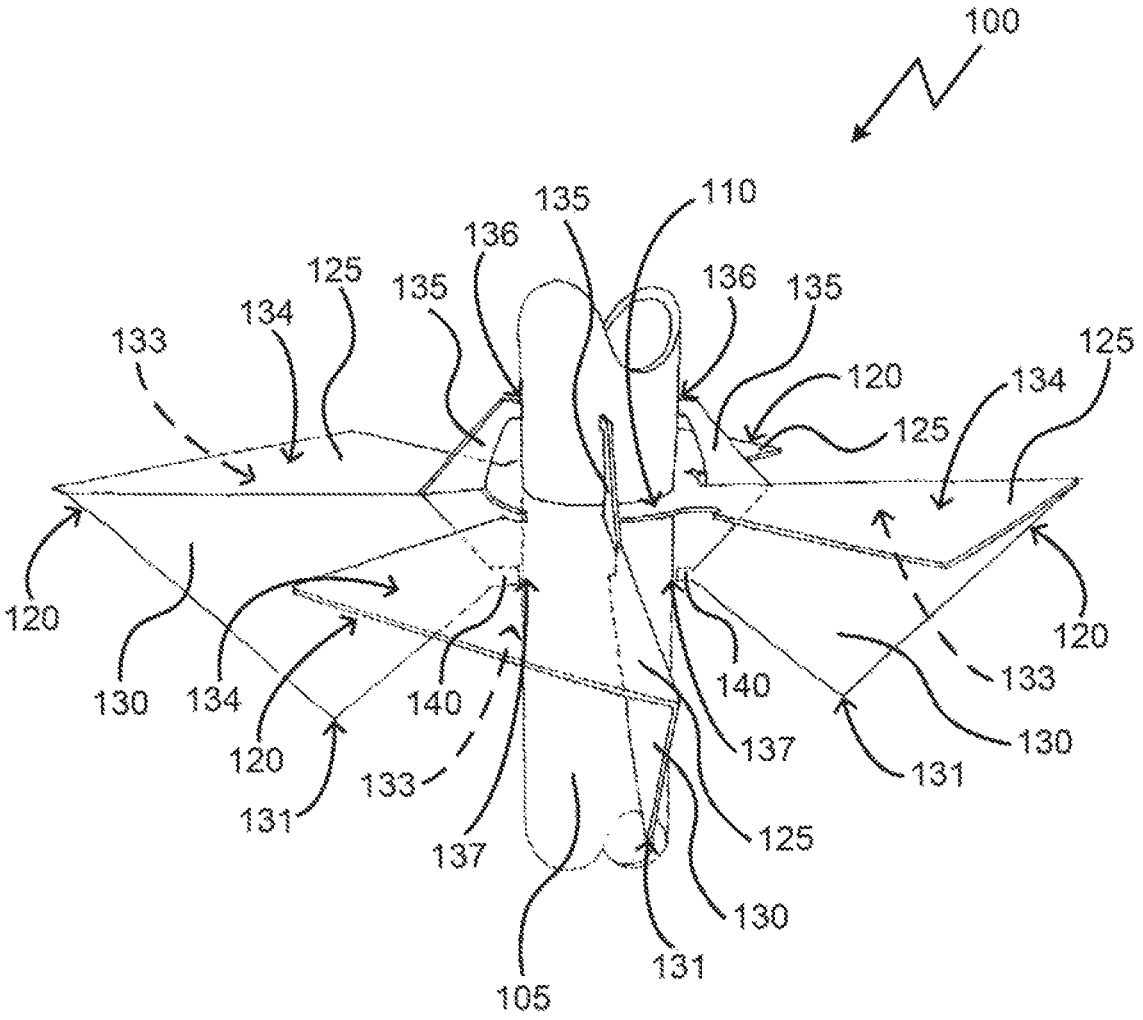
FIG. 1 shows a perspective view of a device for securing a post in accordance with an embodiment of the present invention.
Figure 2:
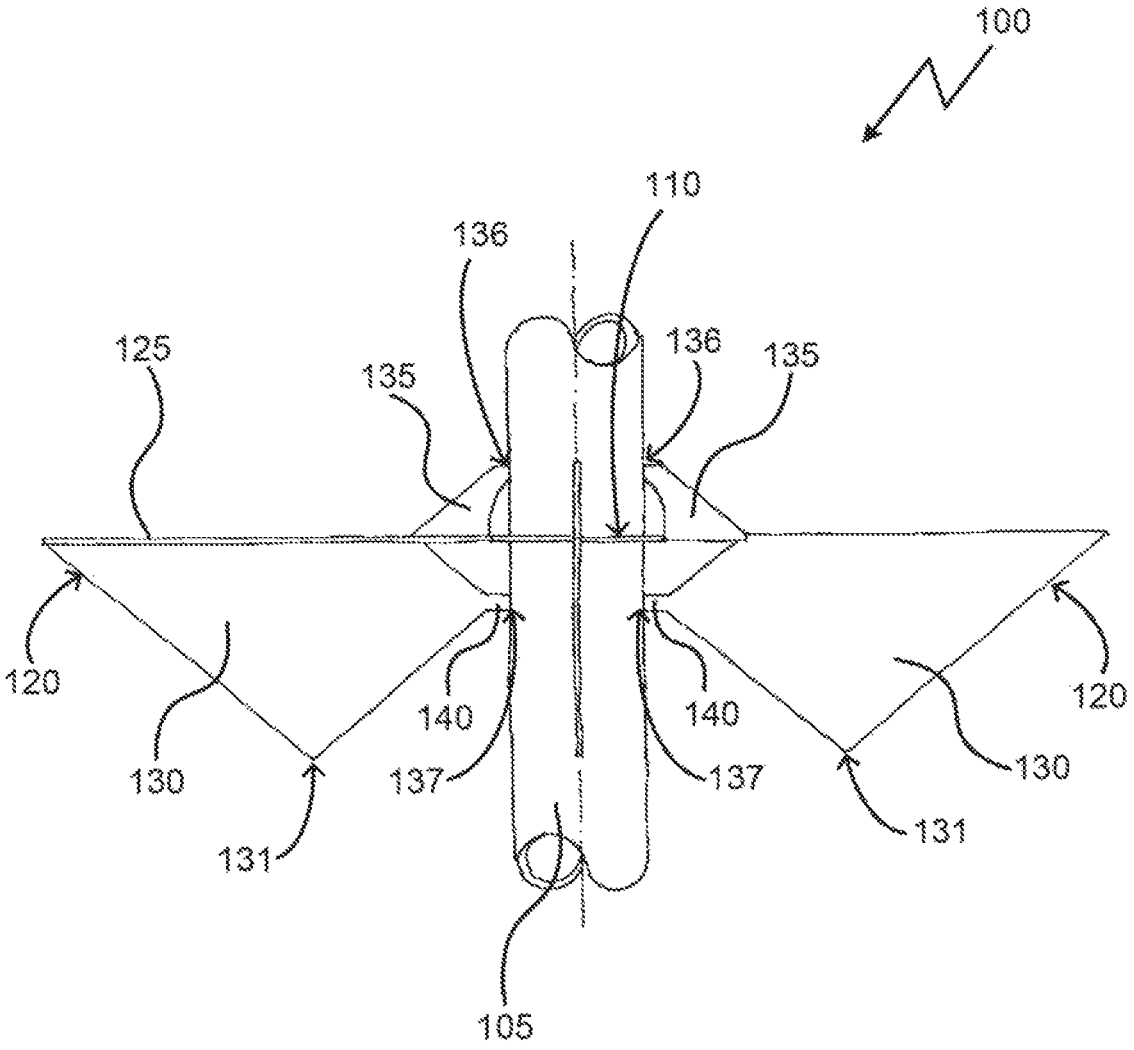
FIG. 2 shows a side view of the device shown in FIG. 1.

FIGS. 1 to 5 show a first embodiment of a device 100 for securing a post 105. The device 100 is formed by cutting and bending a single sheet of material into a pre-defined form. It will be appreciated that the device 100 may alternatively be formed by joining multiple pieces of material together, such as individual items of sheet material. Suitable materials include steel, aluminum, plastic etc. In this embodiment, the device 100 is formed from a single sheet of material measuring approximately 500 mm in width and 500 mm in length. It will be understood that these dimensions may change depending on the required use of the device 100. The device 100 is best shown in a pre-formed arrangement (i.e., as a single sheet of material) in FIG. 4, where the continuous lines indicate the locations at which the material is cut, and the broken lines indicate the locations at which the material is bent.

FIGS. 1 to 3 and 5 show the device 100 in a fully-formed arrangement. The device 100 includes a central portion 110 having an aperture 115 therethrough (see FIG. 4). The central portion 110 is designed to circumferentially engage the post 105. The device 100 further includes a number of support members 120 which extend outwardly from the central portion 110. In this embodiment, there is a total of four support members 120 provided for the device 100. The number of support members 120 may be decreased or increased, depending on various requirements (for example, the length of the post 105 or the physical condition of the area surrounding the post 105). For example, in alternative embodiments, there may be two support members, three support members, five support members etc. Each of the support members 120 includes a first portion 125 and a second portion 130. Each of the second portions 130 includes a cutting edge 131 to facilitate installation of the device 100 into a post-mounting surface 132. In one example, the post-mounting surface 132 may be the top surface of soil in the ground.

Figure 3:
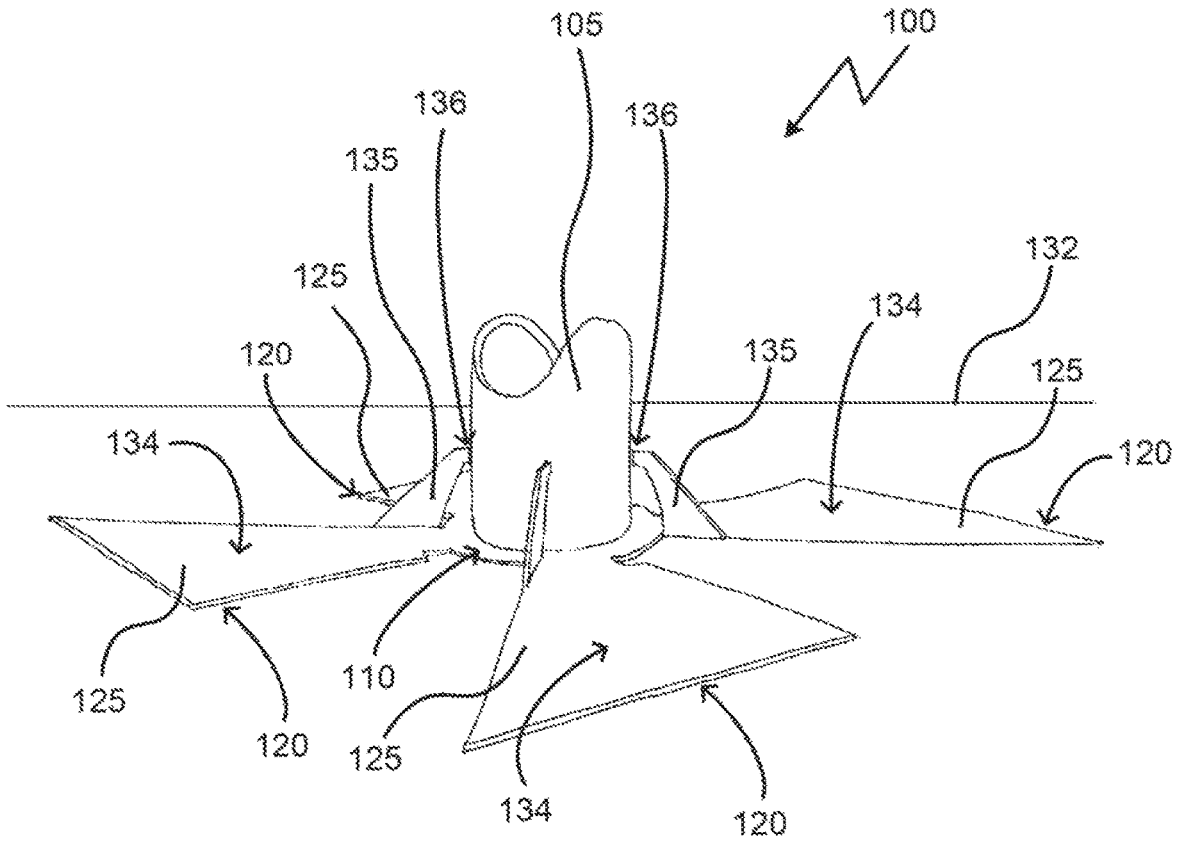
FIG. 3 shows a perspective view of the device shown in FIG. 1, engaging a post-mounting surface.
Figure 4:
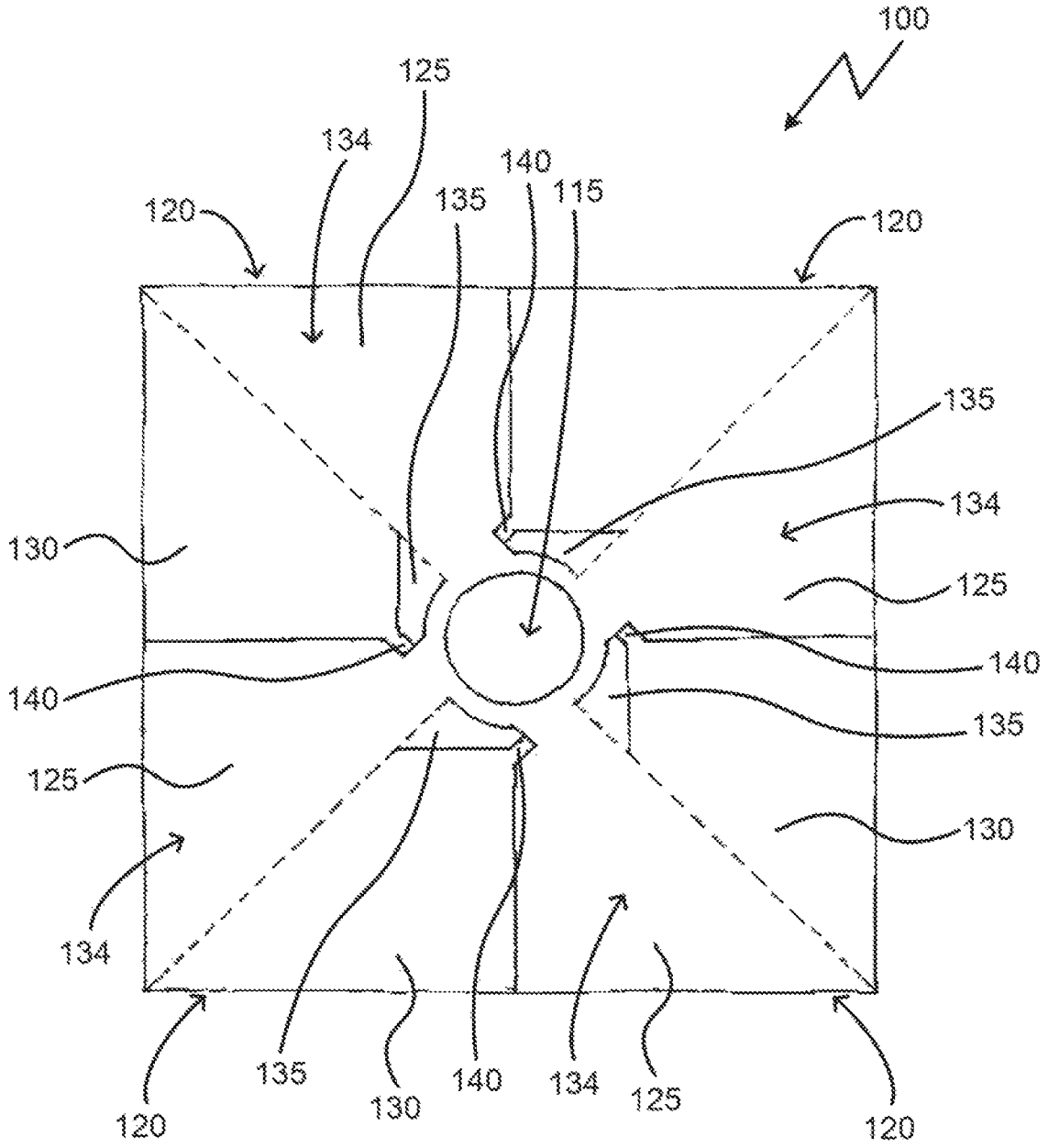
FIG. 4 shows a top view of the device shown in FIG. 1, in a pre-formed arrangement.
Figure 5:
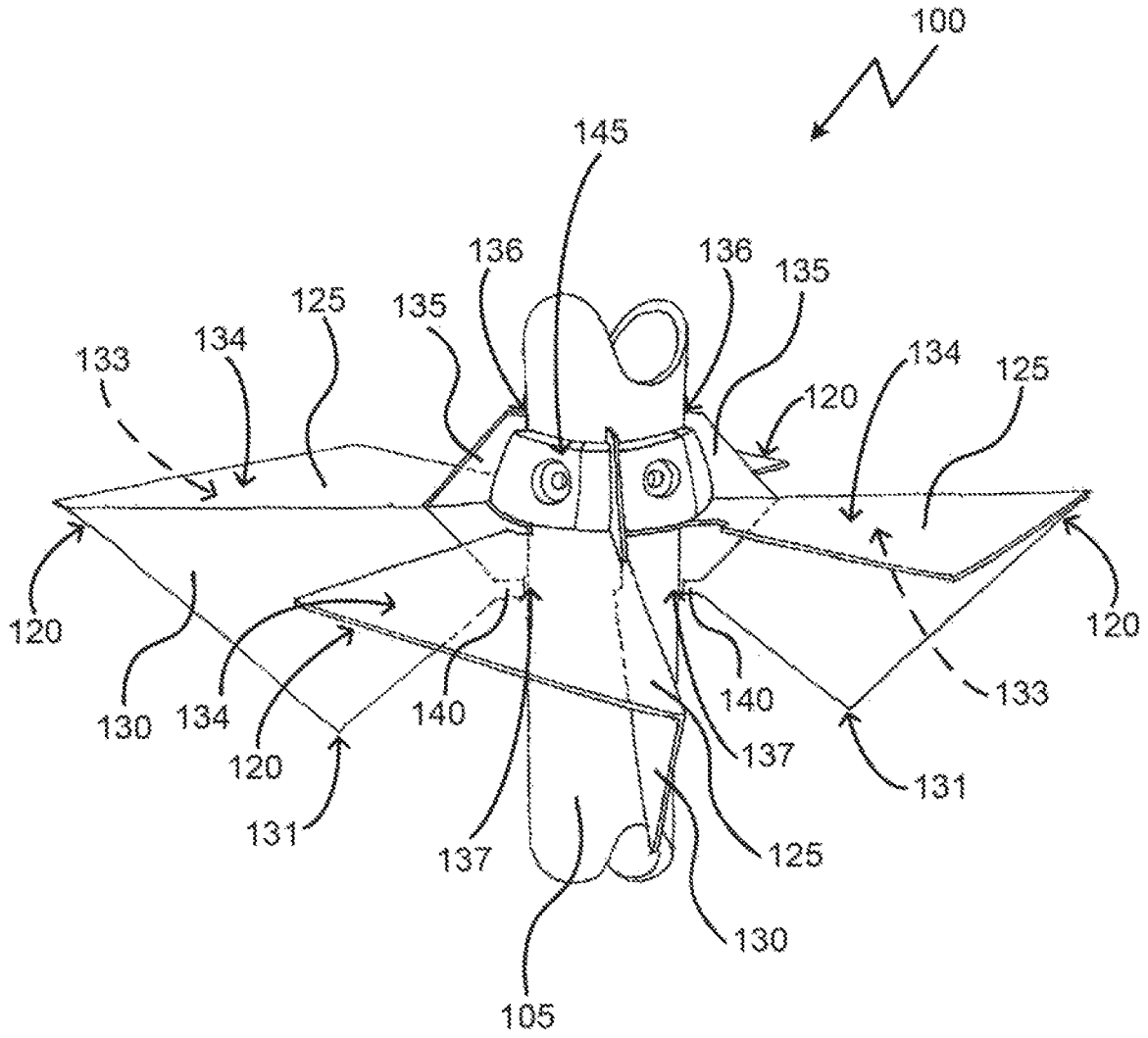
FIG. 5 shows a perspective view of the device shown in FIG. 1, including an additional support structure to secure the device to the post.
Figure 6:
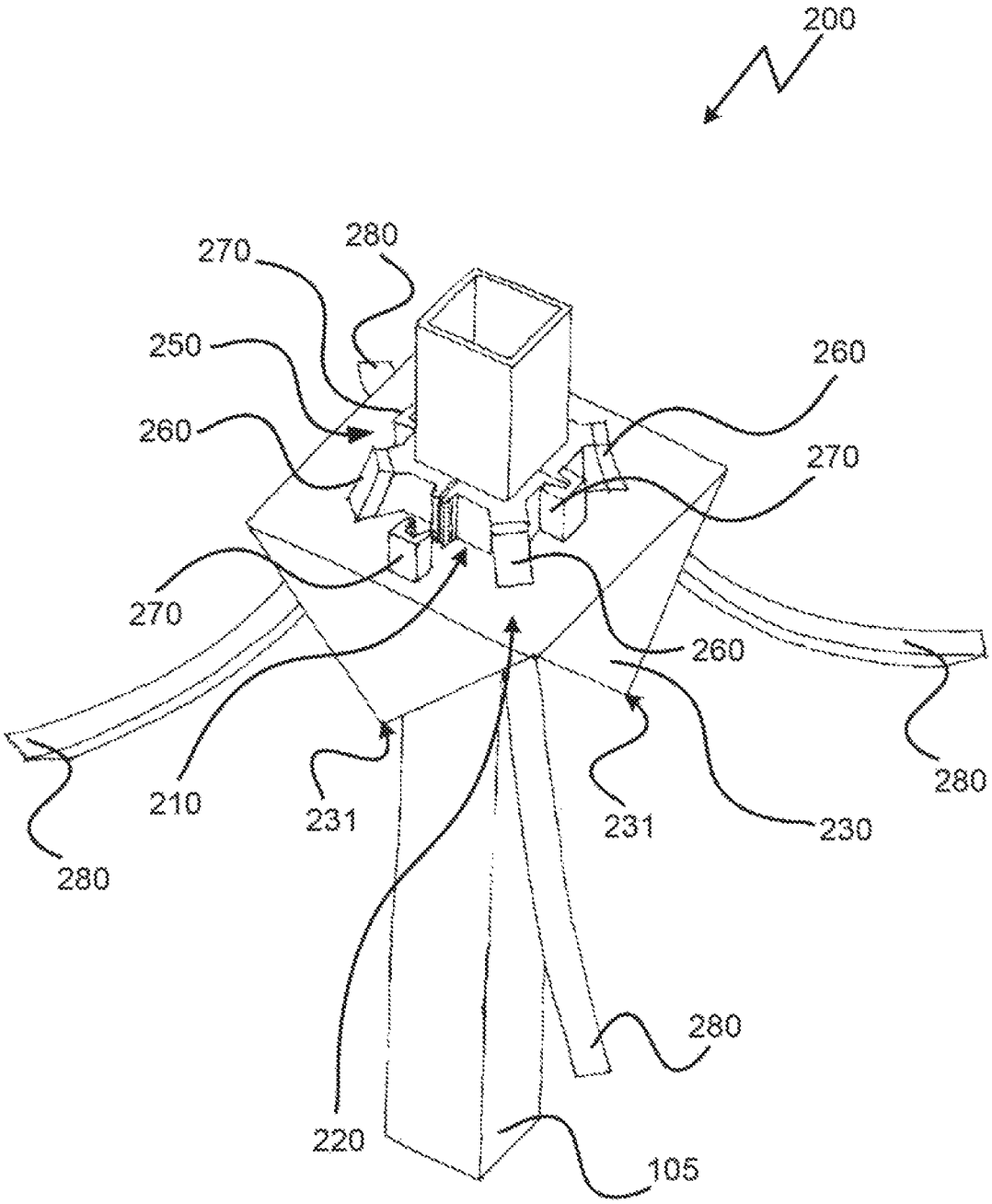
FIG. 6 shows a perspective view of a device for securing a post in accordance with another embodiment of the present invention.

The central portion 110 further includes a first surface 133 (on a lower side of the central portion 110, as best shown in FIGS. 1 and 5) and a second surface 134 (on an upper side of the central portion 110, as best shown in FIGS. 1, 3 and 5). The first surface 133 defines a plane along which the first portion 125 extends. In this embodiment, the second portion 130 extends in a direction substantially perpendicular to the plane. It is envisaged that the second portion 130 may alternatively extend in a direction having an angle of between 85 degrees and 95 degrees, or between 80 degrees and 100 degrees with respect to the plane. The first surface 133 is configured to abut the post-mounting surface 132 and is arranged to be substantially parallel to the post-mounting surface 132.

Each of the first portions 125 has a first support element 135 which initially extends from the first portion 125 in a direction substantially perpendicular to the first portion 125, before extending towards and further engaging the post 105 at a first location 136. Each of the second portions 130 has a second support element 140 which extends towards the second portion 130 in a direction substantially parallel to a plane along which the second portion 130 extends, and further engages the post 105 at a second location 137. The first and second locations 136 and 137 are positioned on the post at opposing sides of the central portion 110.

In this embodiment, the four support members 120 have a combined total of four first portions 125 and four second portions 130. Accordingly, there are four first support elements 135 and four second support elements 140 engaged with the post 105 at various locations around the post 105. The central portion 110 is also engaged with the post 105 around the entire circumference of the post 105. Accordingly, in this embodiment, there is a total of nine points of contact between the device 100 and the post 105. It would be understood that the number of contact points may be increased or decreased. It would also be appreciated that the larger the number of contact points between the device 100 and the post 105, the more secure the post 105 will be with respect to the device 100.

The installation of the device 100 will now be described.

In this example, the installation of the device 100 is described with respect to an existing post 105 (i.e., where one end of the post 105 is already fixed to the post-mounting surface 132). The device 100 is firstly placed in position at the free end of the post 105 such that the post 105 is circumferentially aligned and engaged with the central portion 110. Each of the first and second support elements 135 and 140 are also engaged with the post 105. The device 100 is then moved along the length of the post 105 towards the post-mounting surface 132, until each of the cutting edges 131 of the second portion 130 is in contact with the post-mounting surface 132. The device 100 is then driven into the post-mounting surface 132, such that each of the second portions 130 penetrates the post-mounting surface 132 in a substantially longitudinal direction relative to the post 105 via their respective cutting edge 131. The device 100 reaches a desired depth inside the post-mounting surface 132 when the first surface 133 of the first portion 125 abuts the post-mounting surface 132, thus completing the installation of the device 100. This is best shown in FIG. 3.

It is envisaged that the device 100 may alternatively be driven into the post-mounting surface 132 without the post 105 being present initially. Once the device 100 is fully penetrated in the post-mounting surface 132, the post 105 is subsequently installed as a separate step. Alternatively, the device 100 may firstly be pre-installed to the post 105 at a pre-determined location along the post 105. Thereafter, the device 100 and the post 105 can be simultaneously driven into the post-mounting surface 132.

The nine contact points between the post 105, the central portion 110 and the support elements 135 and 140 according to this embodiment function to secure the post 105 with respect to shear forces acting on the post 105. It would be understood that the shear forces acting on the post 105 are in a direction substantially perpendicular to the longitudinal direction of the post 105. The first and second portions 125 and 130 also have relatively large surface areas which abut and engage the post-mounting surface 132, thus providing additional stability with respect to shear forces acting on the post 105.

In one example, and with reference to FIG. 5, the device 100 may include a locking member 145 configured to engage the post 105 circumferentially around the post 105. The locking member 145 also engages each of the first and second support elements 135 and 140. The inclusion of the locking member 145 allows the surface area of contact between the device 100 and the post 105 to be increased, thus providing additional stability to the post 105. The locking member 145 may be bolted to the post 105 so as to further secure the device 100 to the post 105.

FIGS. 6 to 13 show two further embodiments of a device 200 for securing a post 105. The device 200 has a similar construction and functionality to that of the device 100, with like reference numerals being used to indicate like features. In this embodiment, the device 200 includes a central portion 210 having an aperture 215 therethrough (see FIGS. 8, 11 and 13). The central portion 210 is designed to circumferentially engage the post 105. FIGS. 6 to 9 show a second embodiment whereby the post 105 has a square cross-section and the aperture 215 has a corresponding square shape. FIGS. 10 to 13 show a third embodiment whereby the post 105 has a circular cross-section and the aperture 215 has a corresponding circular shape. The device 200 further includes a support member 220 extending outwardly from the central portion 210. The support member 220 includes a number of support portions 230. In this embodiment, there is a total of four support portions 230 provided for the device 200. It will be appreciated that the number of support portions 230 may be decreased or increased for the same reasons as discussed above with respect to the support members 120 of the first embodiment of the device 100. Each support portion 230 is configured to penetrate a post-mounting surface 132 in a substantially longitudinal direction relative to the post. Each support portion 230 also includes a cutting edge 231 to facilitate installation of the device 200 into the post-mounting surface 132.

Figure 9:
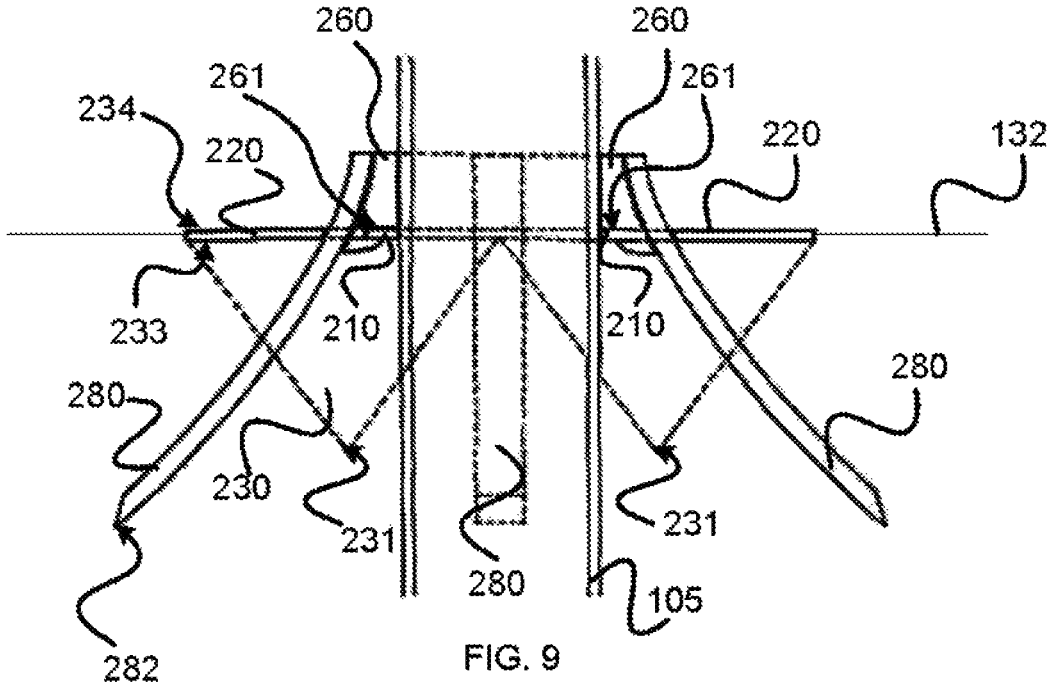
FIG. 9 shows a side view of the device shown in FIG. 6, engaging a post-mounting surface.

Similar to the first embodiment of the device 100 as discussed above, the central portion 210 of the device 200 includes a first surface 233 on a lower side of the central portion 210, and a second surface 234 on an upper side of the central portion 210 (see FIG. 9). The first surface 233 defines a plane along which the support member 220 extends. The support portions 230 of the support member 220 each extend in a direction substantially perpendicular to the plane. As with the second portion 130 of the first embodiment of the device 100, it is envisaged that each of the support portions 230 of the device 200 may alternatively extend in a direction having an angle of between 85 degrees and 95 degrees, or between 80 degrees and 100 degrees with respect to the plane. The first surface 233 is also configured to abut the post-mounting surface 132 and is arranged to be substantially parallel to the post-mounting surface 132

Figure 8:
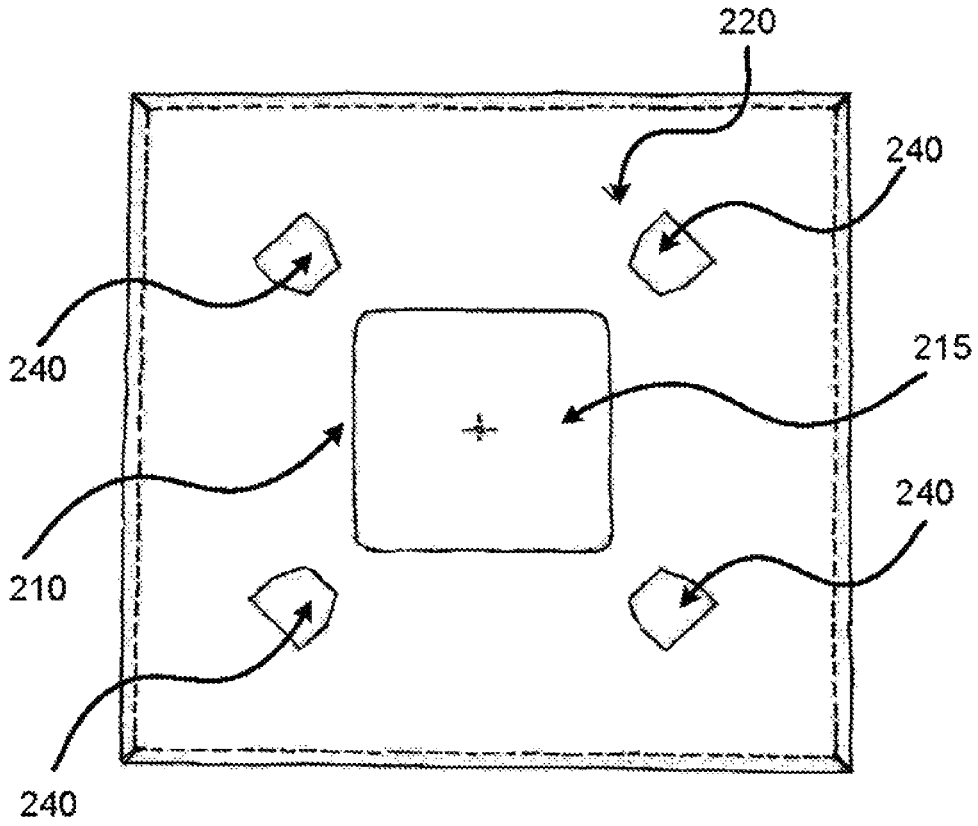
FIG. 8 shows a top view of a support member isolated from the device shown in FIG. 6.
Figure 11:
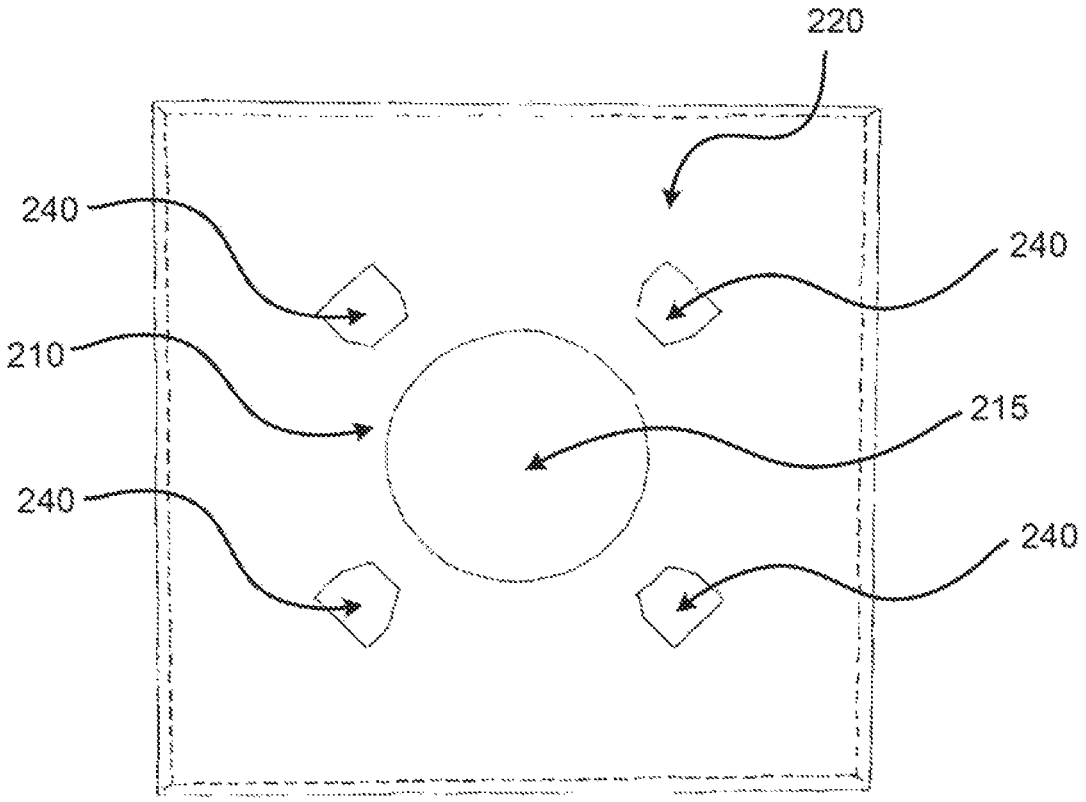
FIG. 11 shows a top view of a support member isolated from the device shown in FIG. 10.
Figure 13:
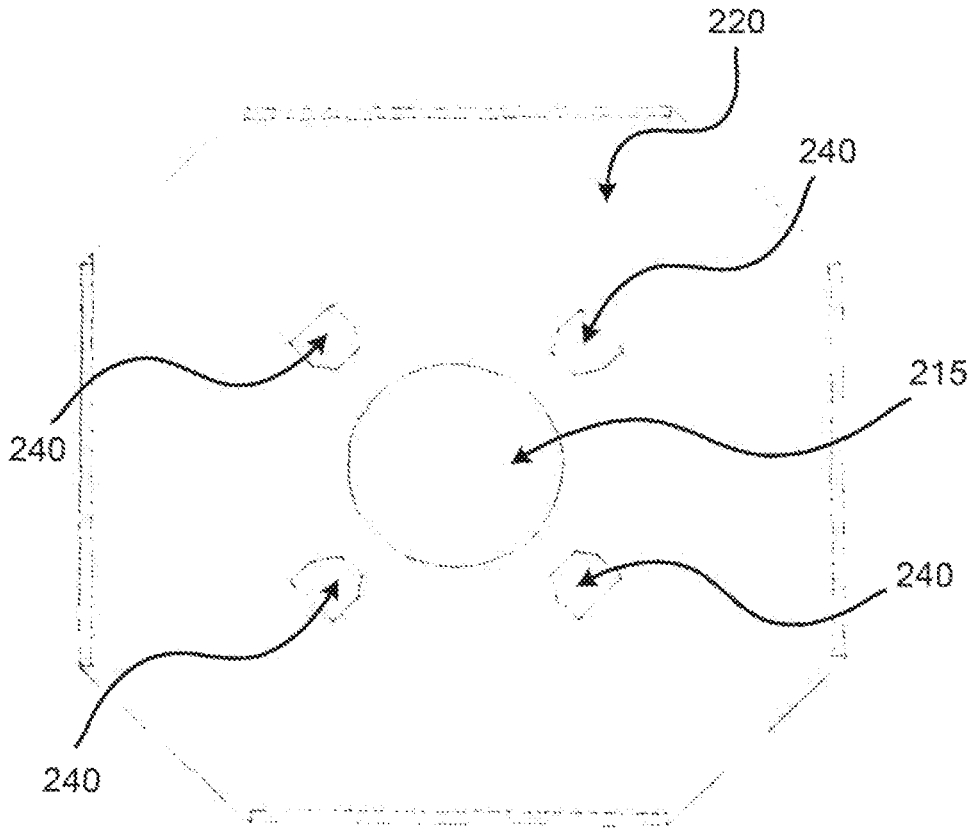
FIG. 13 shows a top view of an alternative arrangement of the support member isolated from the device shown in FIG. 10.

The support member 220 further includes a number of apertures 240, as best shown in FIGS. 8, 11 and 13. In this embodiment, the support member 220 includes four apertures 240. It will be appreciated that the number of apertures 240 may be increased or decreased depending on the support requirements of the device 200, as will be discussed in further detail below.

The device 200 further includes a support assembly 250 that is adapted to be mounted in the apertures 240 and removably engage with the central portion 210 (see FIG. 9). The support assembly 250 includes a number of support elements 260. In this embodiment, the support assembly 250 includes four support elements 260. Each support element 260 is adapted to be mounted in a respective one of the four apertures 240 such that all four support elements 260 are arranged adjacent to one another around the circumference of the post 105. As best shown in FIG. 9, each support element 260 includes a groove 261 adapted to receive and removably engage with the central portion 210. The central portion 210 slides into and engages with the groove 261 of the support element 260 to hold the support element in place 260 against the post 105. Each support element 260 is configured to extend towards and engage the post 105 at various locations around the post 105, thus providing a number of contact points with the post 105 in a similar manner to the first support elements 135 of the first embodiment of the device 100.

Figure 12:
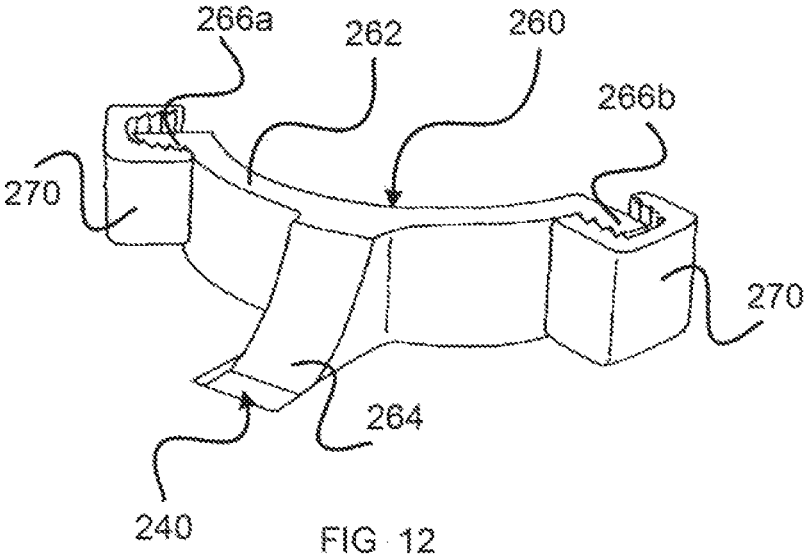
FIG. 12 shows an enlarged view of components of a support assembly of the device shown in FIG. 10.

As best shown in FIG. 12, each support element 260 includes an element body 262 having a central ramp portion 264 and two opposing end portions 266*a* and 266*b*. The central ramp portion 264 has an arcuate surface. The two opposing end portions 266*a* and 266*b* are each arranged to protrude away from the element body 262 to form a flange. Each of the opposing end portions 266*a* and 266*b* includes a serrated or sawtooth-shaped surface.

Figure 7:
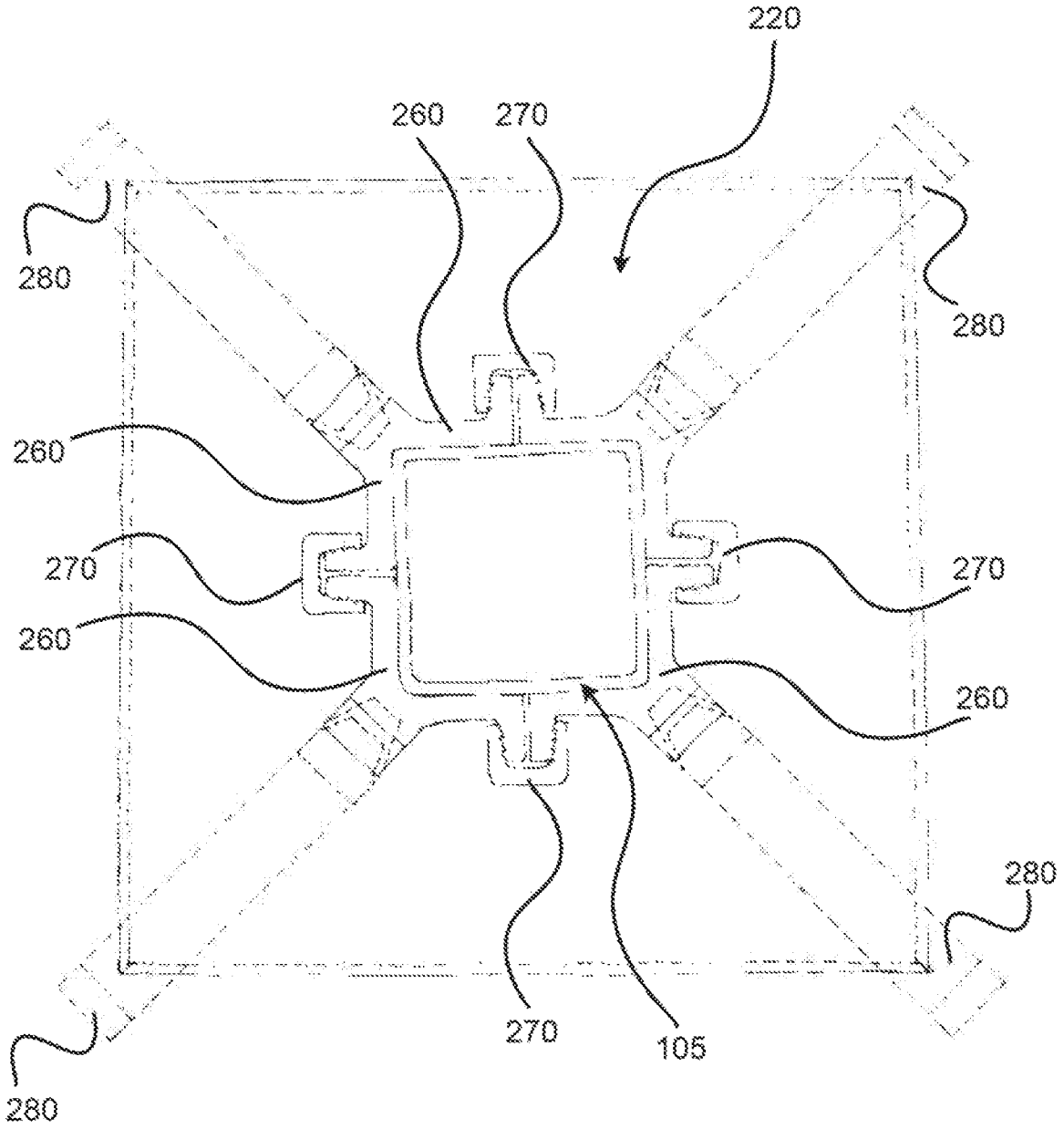
FIG. 7 shows a top view of the device shown in FIG. 6.
Figure 10:
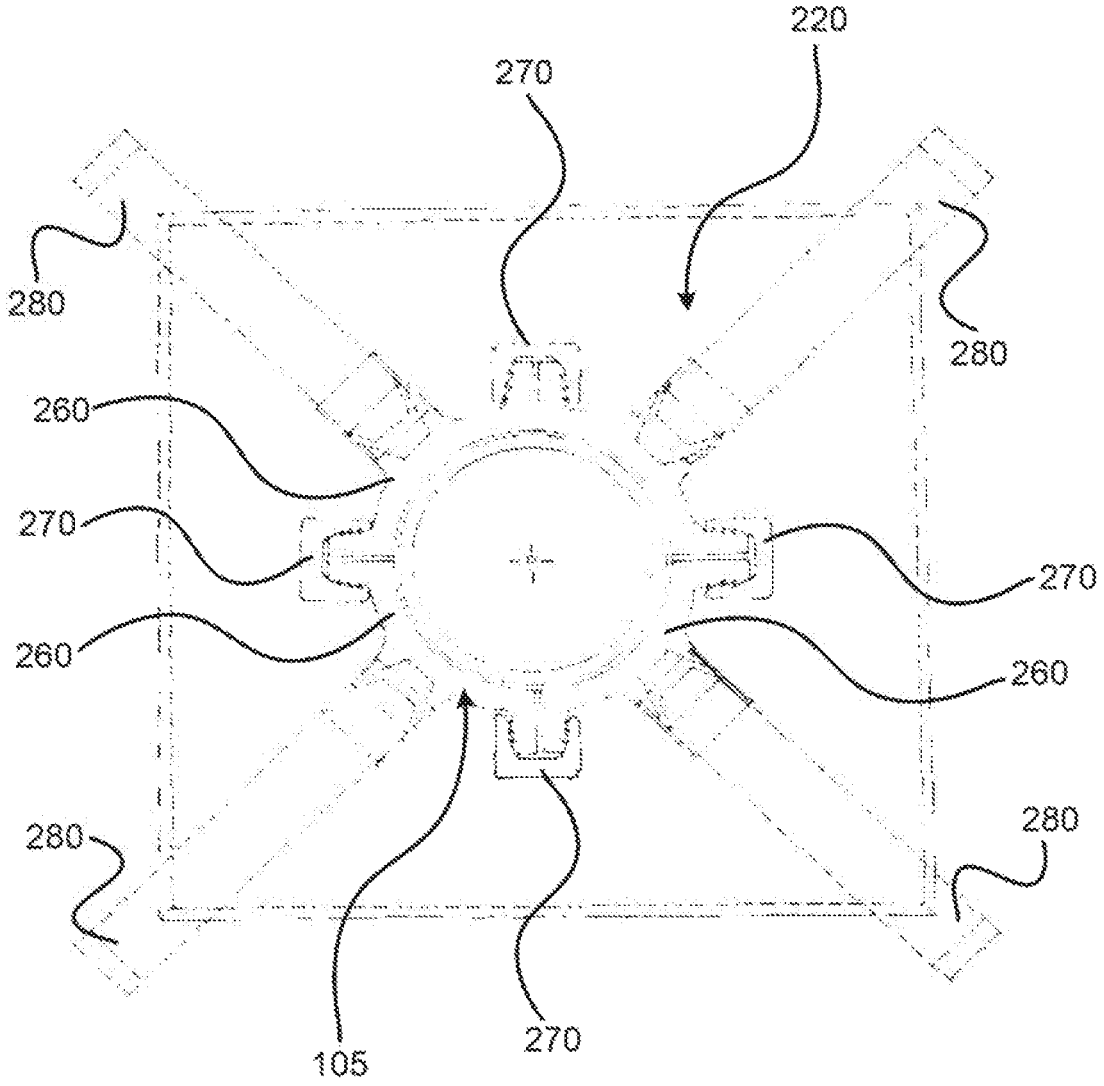
FIG. 10 shows a top view of a device for securing a post in accordance with another embodiment of the present invention.

As best shown in FIGS. 7, 10 and 12, the support assembly 250 further includes a number of clamp members 270, with each clamp member 270 being configured to engage two adjacent support elements 260. In this embodiment, the support assembly 250 includes four clamp members 270 to engage and form a connection between the four adjacent support elements 260. The clamp members 270 each include inner serrated surfaces to engage the serrated surfaces of the end portions 266*a* and 266*b* of the two adjacent support elements 260. Each clamp member 270 is adapted to enclose and engage the end portions 266*a* and 266*b* of the two adjacent support elements 260 by way of a friction or force fit between the respective serrated surfaces. Accordingly, in this embodiment, the four clamp members 270 engage and connect the four support elements 260 to effectively form a tight collar which engages around the post 105, thus securing the post 105 with respect to the device 200. It is envisaged that the clamp members 270 are formed from materials such as cast metal or the like.

The device 200 further includes a number of arcuate legs 280. Each arcuate leg 280 is configured to be inserted in one of the apertures 240 of the support member 220 and engage a respective one of the support elements 260. Each arcuate leg 280 has an arcuate surface that corresponds to the arcuate surface of the central ramp portion 264 of the support element 260. When the arcuate leg 280 is mounted in the aperture 240, the corresponding arcuate surfaces of the arcuate leg 280 and the central ramp portion 264 allow the arcuate leg 280 to rest against and engage the support element 260, which assists in engaging the post 105.

As best shown in FIG. 9, each arcuate leg 280 includes a cutting edge 282 to penetrate the post-mounting surface 132. Each arcuate leg 280 is configured to penetrate the post-mounting surface 132 along an arcuate path corresponding to the shape of the arcuate leg 280. It is envisaged that the arcuate legs 280 are formed from materials such as aluminum, heavy gauge steel or the like.

It will be appreciated that the device 200 is installed in a substantially similar manner to that of the first embodiment of the device 100 as discussed above. In this embodiment, the device 200 is also driven into the post-mounting surface 132, such that each of the support portions 230 penetrate the post-mounting surface 132 in a substantially longitudinal direction relative to the post 105 via their respective cutting edge 231. The device 200 reaches a desired depth inside the post-mounting surface 132 when the first surface 233 of the central portion 210 (and by extension, the support member 220) abuts the post-mounting surface 132, thus completing the installation of the device 200. This is best shown in FIG. 9. The support elements 260 of the support assembly 250, with the assistance of the arcuate legs 280, function to secure the post 105 with respect to shear forces acting on the post 105. It will be appreciated that due to the arcuate manner in which the arcuate legs 280 engage the post-mounting surface 132, the arcuate legs 280 also function to secure the post 105 with respect to longitudinal forces acting on the post 105.

Various forms of the device described above may have one or more of the following advantages. The device may include a number of components which engage with the post at multiple points around the circumference of the post and at multiple points along the length of the post, thereby increasing the capacity of the post to withstand high shear forces acting on the post. The support members of the device may be designed to provide large surface areas which engage the post-mounting surface, thus increasing the stability of the post with respect to the post-mounting surface and also with respect to shear forces acting on the post. The device may be installed without complex machinery, and may also be attached to an existing post without the use of concrete reinforcement or other permanent forms of attachment. This may provide for a relatively simple, efficient and cost-effective way to install, uninstall, re-locate and re-use both the device and the post at another site.

Although the invention has been described with reference to preferred embodiments, it will be appreciated by persons skilled in the art that the invention may be embodied in many other forms.

The invention claimed is:

1. A device for securing a post, comprising:

a central portion defining an aperture therethrough configured to engage the post; and two or more support members extending outwardly from the central portion, each support member comprising a first portion and a second portion, the first and second portions each comprising at least one support element configured to extend towards and further engage the post;

wherein the second portion is configured to penetrate a post-mounting surface in a substantially longitudinal direction relative to the post, thereby securing the post with respect to shear forces acting on the post in a direction substantially perpendicular to the longitudinal direction;

wherein the central portion comprises a first surface and a second surface, the first surface defining a plane along which the first portion extends, wherein the second portion of the support member extends in a direction substantially perpendicular to the plane;

wherein the first surface is configured to abut the post-mounting surface and is arranged to be substantially parallel to the post-mounting surface;

wherein a first support element of the first portion engages with the post at a first location, wherein the first location is positioned on a first side of the central portion, and a second support element of the second portion engages with the post at a second location, wherein the second location is positioned on a second side of the central portion, and wherein the first and second sides of the central portion are opposing; and wherein an inner edge of the central portion engages with the post circumferentially around the post.

2. The device of claim 1, wherein the first support element initially extends from the first portion in a direction substantially perpendicular to the plane along which the first portion extends before extending towards the post, and the second support element extends towards the post in a direction parallel to a plane along which the second portion extends.

3. The device of claim 1, wherein the second portion comprises a cutting edge to penetrate the post-mounting surface.

4. The device of claim 1, wherein the device is configured to rotate relative to the post.

5. The device of claim 1, wherein the central portion and the two or more support members are integrally formed.

6. The device of claim 1, wherein the first and second portions of each support member are integrally formed.

7. A device for securing a post, the device comprising:

a central portion defining an aperture therethrough configured to engage the post; and a support member extending outwardly from the central portion, the support member comprising two or more support portions;

wherein the two or more support portions are each configured to penetrate a post-mounting surface in a substantially longitudinal direction relative to the post, thereby securing the post with respect to shear forces acting on the post in a direction substantially perpendicular to the longitudinal direction;

wherein the support member includes two or more apertures, the device further comprising a support assembly adapted to be mounted in the two or more apertures and removably engage with the central portion, wherein the support assembly comprises two or more support elements, each support element being configured to extend towards and further engage the post, and wherein the support assembly further comprises two or more clamp members, each clamp member being configured to engage with two adjacent support elements.

8. The device of claim 7, further comprising two or more arcuate legs, each arcuate leg being configured to be inserted into one of the apertures of the support member and engage the support element to assist in engaging the post.

9. The device of claim 8, wherein each arcuate leg comprises a cutting edge.

10. The device of claim 7, wherein each support portion comprises a cutting edge.

* * * * *